US006474856B2

(12) United States Patent
Billot

(10) Patent No.: US 6,474,856 B2
(45) Date of Patent: Nov. 5, 2002

(54) MOTOR VEHICLE HEADLIGHT EQUIPPED WITH A DISCHARGE LAMP AND WITH IMPROVED ELECTROMAGNETIC SCREENING MEANS

(75) Inventor: Gérard Billot, Bobigny Cedex (FR)

(73) Assignee: Valeo Vision, Bobigny (FR)

( * ) Notice: Subject to any disclaimer, the term of this patent is extended or adjusted under 35 U.S.C. 154(b) by 21 days.

(21) Appl. No.: 09/726,071

(22) Filed: Nov. 29, 2000

(65) Prior Publication Data

US 2001/0030877 A1 Oct. 18, 2001

(51) Int. Cl.[7] ..... B60Q 1/00

(52) U.S. Cl. ..... 362/548; 362/267; 362/344; 362/546

(58) Field of Search ..... 362/265, 267, 362/344, 516, 538, 546, 548, 263

(56) References Cited

U.S. PATENT DOCUMENTS 5,465,195 A * 11/1995 Jenner et al. ..... 362/548
5,879,073 A * 3/1999 Hori et al. ..... 362/263
6,099,726 A * 8/2000 Gembolis et al. ..... 210/243

FOREIGN PATENT DOCUMENTS

| | | |
|---|---|---|
| DE | 197 37 640 | 3/1998 |
| EP | 0 905 441 | 3/1999 |
| FR | 2 710 131 | 3/1995 |
| WO | 98 38708 | 9/1998 |

* cited by examiner

*Primary Examiner*—Sandra O'Shea
*Assistant Examiner*—Guiyoung Lee
(74) *Attorney, Agent, or Firm*—Morgan & Finnegan, LLP

(57) ABSTRACT

A motor-vehicle headlight uses a gas-discharge lamp with a power-supply circuit, the lamp being mounted in a mirror. A screening device reduces interfering electromagnetic emissions.

The power-supply circuit is in a housing to the rear of the lamp, and the screening device has a conducting material entirely surrounding the housing and able to provide electrical continuity between a screening braid of a power-supply cable arriving at the said housing and screening arrangements which are associated with the mirror.

The invention also proposes a gas-discharge lamp incorporating such screening means.

32 Claims, 3 Drawing Sheets

MOTOR VEHICLE HEADLIGHT EQUIPPED WITH A DISCHARGE LAMP AND WITH IMPROVED ELECTROMAGNETIC SCREENING MEANS

FIELD OF THE INVENTION

The present invention relates, in a general way, to headlights with a discharge lamp.

BACKGROUND OF THE INVENTION

Normally such a headlight comprises a reflector in which is mounted a discharge lamp, supplied with power by a separate high-voltage power-supply module, fixed, for example, in or onto the casing of the headlight. A screened cable links the power-supply module to the lamp, while the electromagnetic emissions in the region of the lamp and of its power-supply module are trapped by specific screening arrangements.

Discharge lamps have recently been developed characterized by having all or part of the high-voltage power-supply circuit present in a fixed or removable base of the lamp. Recourse is thus avoided to a power-supply casing housing the converter and high-voltage circuits, and therefore heavy and bulky, and difficult to place in a motor-vehicle headlight the requirements of which in terms of compactness and of lightness are constantly increasing. Hence, with this type of lamp, only one DC—DC converter circuit has to be provided separately from the lamp, with a substantially reduced weight and bulk.

One difficulty which can be expected with this new type of lamp, however, lies in the problems of electromagnetic compatibility as regards the power-supply circuits associated with the lamp.

Hence, in order to improve the electromagnetic compatibility all round the headlight, it may prove to be necessary to design the adjoining bodywork of the vehicle in such a way that it participates in the screening with respect to the stray electromagnetic emissions.

It will be understood that this will constitute an undesirable constraint on the constructors, given that they wish to preserve complete freedom in the design of the bodywork at the front of the vehicle. Such an approach is inapplicable, moreover, in the case of bodywork made of composite materials, or more generally non-conducting materials.

The present invention aims to overcome these problems of the prior art, and to propose a headlight which, in itself, without increasing the weight, complexity or cost price either of its casing or of other elements, and without having to design the adjacent bodywork in a specific way as regards these questions of interference, is able to satisfy the usual requirements in terms of electromagnetic compatibility.

SUMMARY OF THE INVENTION

To that end, according to a first aspect, it proposes a motor-vehicle headlight, comprising a gas-discharge lamp combined with a power-supply circuit and mounted in a mirror, and means of screening with respect to interfering electromagnetic emissions, characterized in that the said power-supply circuit is accommodated in a housing associated with the lamp to the rear thereof, and in that the screening means comprise a conducting material entirely surrounding the said housing and able to provide electrical continuity between a screening braid of a power-supply cable arriving at the said housing and screening arrangements which are associated with the mirror.

Preferred, but non-limiting, aspects of the headlight according to the invention are as follows:

- the said conducting material belongs to a casing defining the said housing,
- the said conducting material is mechanically fixed to the outside of the said casing,
- the said conducting material is deposited on an outer face of the said casing,
- the said conducting material belongs to a cover affixed to the rear of the mirror and surrounding a non-conducting casing defining the said housing,
- the headlight comprises first linking means for ensuring electrical continuity between the said conducting material surrounding the said housing and a second, screening, conducting material provided at the rear surface of the mirror,
- the first linking means comprise a series of clips electrically linked to the said second conducting material and bearing against the said first conducting material,
- the said clips are mounted on a lamp holder affixed to the mirror,
- the first linking means comprise arrangements for supporting the said cover against the said second conducting material at the rear of the mirror,
- the first linking means comprise a deformable seal made of electrically conducting material, interposed between the first and second conducting materials,
- the deformable seal is mounted on the mirror,
- the deformable seal is mounted on a lamp holder affixed to the mirror,
- the headlight comprises second linking means for ensuring electrical continuity between the said conducting material surrounding the said housing and the said screening braid,
- the casing of the lamp possesses a first connector, the end of the power-supply cable possesses a second connector able to plug into the first connector, and, when the first and second connectors are separated, the said second linking means are able to break the electrical continuity between the said conducting material surrounding the said housing and the said screening braid only after the contacts of the first and second connectors carrying the power-supply voltage for the lamp have been separated,
- the second linking means comprise a series of clips carried by the said second connector, the said clips being in contact with the screening braid and with the conducting material surrounding the casing,
- the said second linking means comprise a conducting seal in contact with the screening braid and with the conducting material surrounding the casing,
- an elastic means is provided for retaining the lamp in axial position, the said means bearing against the conducting, screening material, and the said elastic means, which is conducting and which, in retaining position, is in contact with the said screening braid of the cable, forms part of the said second linking means,
- the said second linking means comprise arrangements for support against the braid of the power-supply cable, which are formed on the said cover around an orifice for the said cable to pass,
- the headlight comprises a conducting elastic element able to bear against the said conducting material in the region of a rear face of the said casing, in order simultaneously to retain the lamp in axial direction and to provide electrical continuity for screening with other screening elements of the headlight, the said housing forms an integral part of the lamp, the said housing forms part of a connector on which the lamp is mounted removably, the headlight further comprises control circuits accommodated in an electrically conducting control box situated at a distance from the lamp, and third linking means for ensuring electrical continuity between the said control box and the braid of the cable, the third linking means comprise a third connector provided on the control box and a fourth connector provided at the end of the power-supply cable opposite to the lamp and able to be plugged into the third connector, and, when the third and fourth connectors are separated, the said third linking means are able to break the electrical continuity between the said control box and the said screening braid only after the contacts of the third and fourth connectors carrying the power-supply voltage for the lamp have been separated.

According to a second aspect, the present invention proposes a gas-discharge lamp for a motor-vehicle headlight, the said lamp being combined with a power-supply circuit, characterized in that it incorporates the said power-supply circuit in a housing, and in that it further comprises screening means comprising a conducting material entirely surrounding the said housing and able to ensure electrical continuity between a screening braid of a power-supply cable arriving in the housing and screening arrangements provided on a mirror able to accommodate the said lamp.

BRIEF DESCRIPTION OF THE DRAWINGS

Other aspects, objects and advantages of the present invention will emerge better on reading the following detailed description of various embodiments thereof, given by way of non-limiting example and by reference to the attached drawings, in which.

DESCRIPTION OF THE PREFERRED EMBODIMENTS

Figure 1:
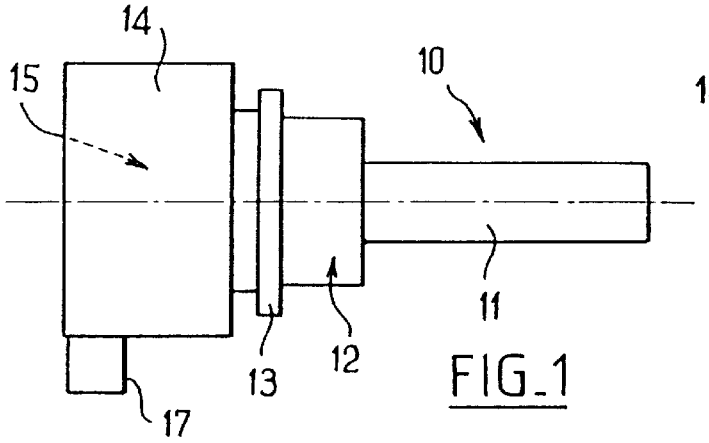
FIG. 1 is a side view of a discharge lamp according to a first embodiment of the invention.
Figure 2:
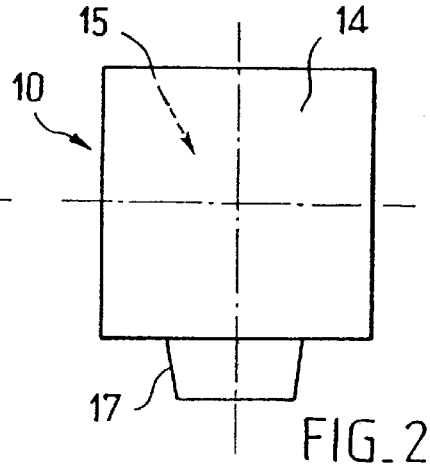
FIG. 2 is a back view of the lamp of FIG. 1.

In the various figures, like reference numerals refer to like parts.

By reference first of all to FIGS. 1 to 4, a discharge lamp 10 has been represented which comprises an outer bulb 11, sheltering—in a way which is not illustrated and known in itself—an inner bulb holding a gaseous mixture and two electrodes in order to form a luminescent arc via a gas-discharge phenomenon.

To the rear of the bulb 11 extends a lamp body 12 possessing a collar 13 intended to co-operate with appropriate support parts of the mirror so as to reference the position of the lamp therein, this body being extended to the rear by a casing 14 formed, for example, in a single piece with the body, the whole being made of appropriate plastic, and defining a cavity 15 intended to shield the electronic circuits (not represented) making it possible to supply power to the lamp at the appropriate voltages. This casing 14 defines, at its lower part, a connector 17 able to cooperate with a complementary connector (not illustrated) at the end of a screened cable for supplying power to the lamp 10, supplying a voltage, preferably a DC voltage higher than that of the on-board network of the vehicle, produced by an appropriate DC/DC converter, and processed in an appropriate way by the power-supply circuits.

It will be observed here that the present invention applies equally well to a lamp in which the casing is affixed removably, by means of an appropriate connector, at the rear of the lamp.

Figure 3:
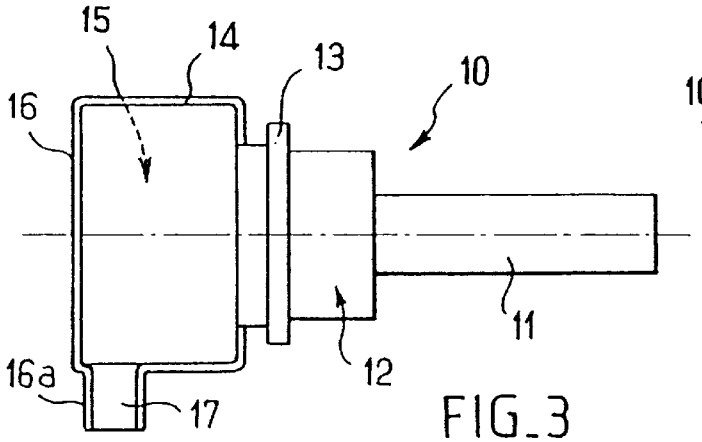
FIG. 3 is a side view, partially in section, of the lamp of FIGS. 1 and 2.
Figure 4:
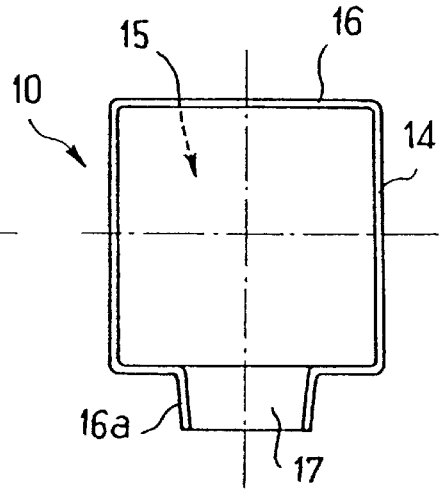
FIG. 4 is a back view, partially in section, of the lamp of FIGS. 1 to 3.

According to a first embodiment of the invention, and as illustrated in FIGS. 3 and 4, the casing 14 for the power-supply circuits receives an essentially continuous conducting outer envelope 16 intended to trap the stray electromagnetic emissions emitted by these circuits, so as to perfect the screening to which, in a way which is known in itself, the mirror of the headlight and a metal shade placed in the mirror in front of the lamp already contribute.

According to a first implementation, this envelope 16 is produced in the form of a thin metal sheet affixed around the casing 14.

According to a second implementation, this envelope is produced by deposition, especially by chemical or physical means, of at least one conducting layer 16 on the outer face of the casing. According to one variant, provision can be made to form this deposition on the inner face of the casing, auxiliary conducting means being provided in this case so that the continuity of the screening with the other parts of the headlight, external to this casing, can be achieved.

It will be observed that the thin envelope is extended, at 16*a*, in the region of the connector 17, so as to leave accessible strictly only what is necessary to provide for the connector 17 to interact with its complementary connector.

Figure 5:
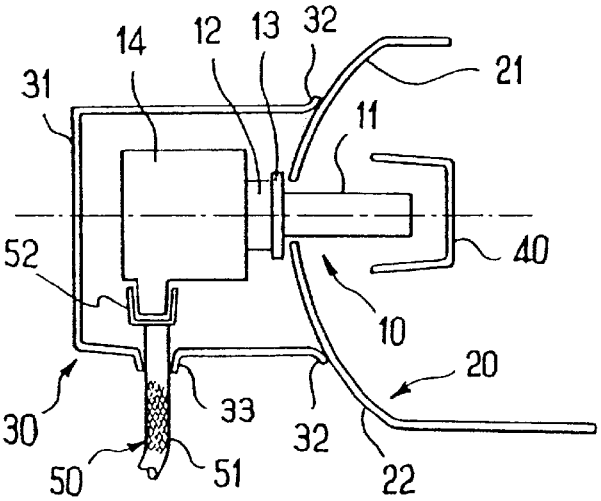
FIG. 5 is a side view, partially in section, of a lamp/mirror assembly according to a second embodiment of the invention.
Figure 6:
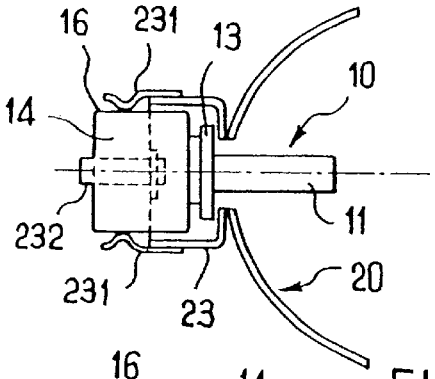
FIG. 6 is a side view, partially in section, of the mounting of a lamp according to the first embodiment of the invention in a mirror of the headlight.
Figure 7:
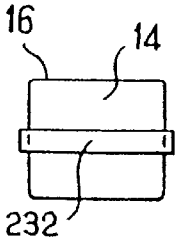
FIG. 7 is a partial back view illustrating a detail of the mounting of FIG. 6.

FIG. 5 illustrates the principle of a second embodiment of the invention. In this figure, the lamp 10 produced as before has been illustrated, but with a casing 14 itself devoid of screening, a mirror 20 in which the lamp is mounted, and a metal shade 40. The mirror 20, on its rear face opposite its reflecting surface 21, possesses a conducting layer 22 affixed mechanically or deposited by physical or chemical means. This conducting layer 22 and the shade 40 are both, in a way which is known in itself, connected to earth in order to participate in the screening with respect to interfering electromagnetic emissions, principally as regards the arc and the electrodes of the lamp.

Also represented in FIG. 5 is a power-supply cable 50, provided with a bare, outer screening braid 51 and terminating in a connector 52 able to interact with the connector 17 provided on the casing 14 of the lamp. This cable, at its other end, preferably possesses a similar connector, capable of ensuring, under the same conditions, continuity of the screening with an earthed conducting casing sheltering the above mentioned DC—DC converter and, more generally, control circuits of the headlight.

According to the second embodiment of the invention, the casing 14 of the lamp, which protrudes from the rear of the mirror, is accommodated within a conducting cover 30 affixed to the rear of the mirror.

This cover possesses a main wall 31 situated face-to-face with the rear face and the side and upper and lower faces of the casing 14, while, at its open front end (to the right in FIG. 5), it features peripheral arrangements, such as bends 32 or clips, intended to provide electrical continuity with the conducting layer 22 of the mirror.

In a variant, or additionally, it is possible to interpose between the front end of the cover 30 and the rear face of the mirror possessing the conducting layer 22 a deformable seal made of electrically conducting material, which can be mounted either on the cover or on the mirror.

The cover 30 also possesses an aperture, in the region of its lower wall, surrounded by arrangements 33 such as clips, able to provide electrical contact with the bare screening braid 51 of the cable 50. Here again, a conducting seal can be used.

It will be observed here that it is the cover 30 which provides the electrical continuity between the earthed screening elements constituted by the braid 51 and by the conducting layer 22 of the mirror 20, while the shade 40 is linked to the conducting layer 22 by conducting support lugs, not represented.

FIGS. 6 to 9 illustrate one possible embodiment for mounting the lamp as described above by reference to FIGS. 1 to 4 in a mirror.

Here the mirror possesses, either in a single piece, or affixed to it, a bell-shaped element 23 extending to the rear of the mirror around the lamp hole and open to the rear.

The lamp is mounted in the mirror through the rear in such a way that its casing 14, with conducting outer layer 16, comes to be engaged partially in the bell 23.

This bell carries, at its periphery, a plurality of metal clips 231 having appropriate elasticity properties, and made of spring steel, for example, which are able, when the lamp is put in place, to come to bear against the conducting layer 16 of the casing 14.

These clips are linked electrically, moreover, to the conducting layer 22 situated at the rear of the mirror 20, in order thus to ensure electrical continuity of the screening between the mirror and the casing 14 of the lamp.

Moreover, means are advantageously provided on the bell 23 for retaining the lamp 10 in position, which consist of a leaf spring 232 or other elastic element, one end of which is mounted so as to be articulated onto the said bell and the opposite end of which can be latched on to the latter on the opposite side. In this position, the leaf spring 232 bears on the rear face of the casing 14 so as to retain the lamp in its reference position defined by the support of the collar 13 on appropriate arrangements surrounding the lamp hole of the mirror. It will be noted here that the leaf spring 232 also contributes to the electrical continuity of the screening.

Figure 8:
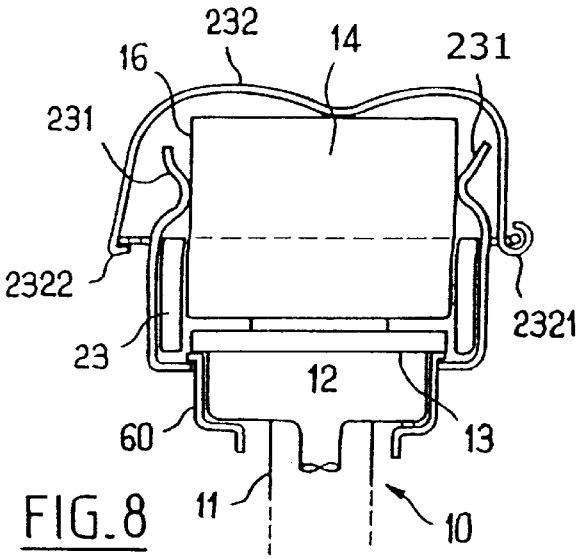
FIG. 8 is a view in partial section illustrating the mounting of FIG. 7 in more detail.

FIG. 8, in particular, illustrates the pivoting mounting of the leaf spring 232 at its end 2321, and the latching of the said leaf spring at its opposite end 2322.

Furthermore, FIG. 8 also shows that the clips 231 are extended forwards (that is to say downwards on the figure) so as to meet up with a conducting piece 60 belonging to the lamp holder, which is engaged in the lamp hole of the mirror and in contact both with the conducting layer 22 of the mirror and with the shade 40 (not represented) by means of fixing lugs thereof (also not represented).

Figure 9:
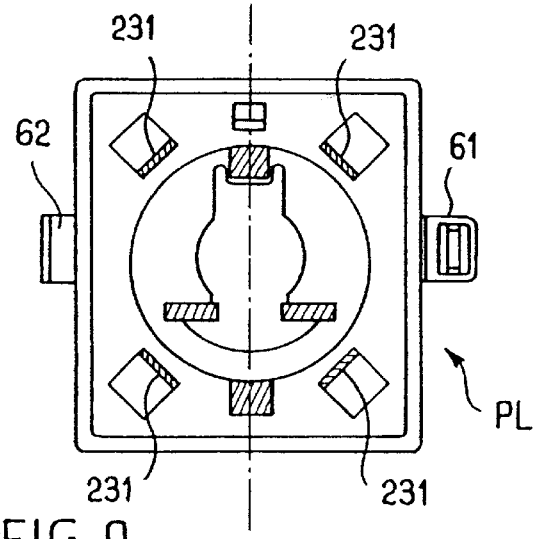
FIG. 9 is a back view of a lamp holder used in the mounting of FIG. 8.

FIG. 9 for its part illustrates the lamp holder PL as a whole, carrying four clips 231 and provided with respective arrangements 61, 62 for the pivoting mounting of the retaining leaf spring 232 and for its fastening in latched position.

In a variant of the various forms of clips described above, or in addition to them, one or more deformable seals made of electrically conducting material can be used, which are able to be compressed between the conducting surfaces between which the electrical continuity has to be ensured.

Figure 10:
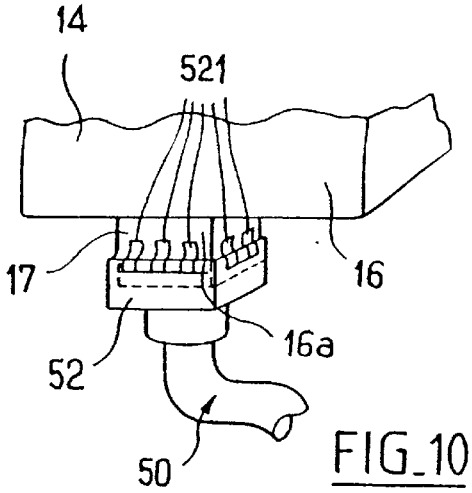
FIG. 10 illustrates a means for screening continuity between lamp and cable used with a lamp according to the invention.

FIG. 10 diagrammatically represents, in perspective, the interaction between the connector 17 belonging to the casing 14 of the lamp and the complementary connector 52 provided at the end of the screened power-supply cable.

Thus, the body of this complementary connector 52 carries a series of elastic and electrically conducting clips 521 able to come to bear, when the connectors are assembled, against the conducting layer **16*a* surrounding the connector 17. The electrical continuity of the screening is thus ensured between the outer braid 51 of the cable 50 and the conducting coating 16, 16*a* of the lamp casing 14**, and, as a consequence, with the other elements, mainly mirror and shade, participating in the screening.

Here again, the clips 521 can be replaced or supplemented by a deformable seal made of electrically conducting material compressed between the surfaces between which the electrical continuity of screening has to be ensured.

It will be noted here that, advantageously, the connectors 17 and 52 are designed such that disconnecting them first of all causes disconnection of the conductor or conductors carrying the power-supply voltage for the lamp, and, only then, disconnection of the link providing the continuity of the screening. Conversely, when the connectors 17 and 52 are assembled, the continuity of the screening will be established before the power-supply connector or connectors proper.

In the same way, it is advantageous for the connectors present between the opposite end of the cable 50 and the control box belonging to the headlight and situated remotely from the lamp to exhibit the same behavior.

Figure 11:
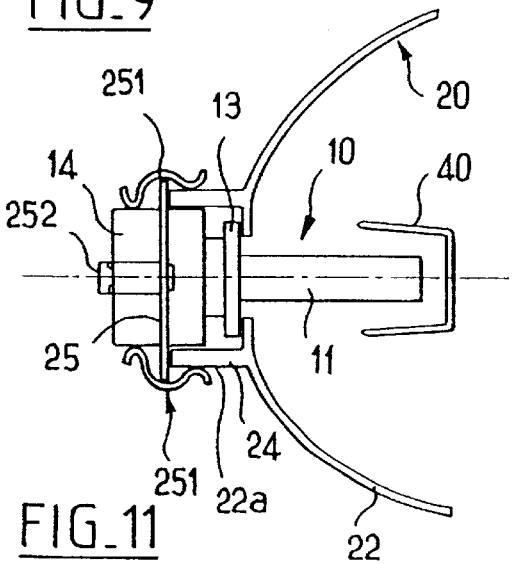
FIG. 11 is a side view, partially in section, of a variant of the lamp/mirror assembly of FIG. 5.

FIG. 11 for its part illustrates another implementation for mounting a lamp according to FIGS. 1 to 4 at the rear of the mirror 20.

The lamp hole is surrounded by an axial collar 24 and a conducting crown ring 25 is mounted, for example by screws, on to the free annular surface defined by the collar 24 at its rear end.

This crown ring 25 carries, at its periphery, a series of double clips 251 a forward part of which is able to come into contact with the conducting layer 22 formed at the rear of the mirror 20 (this conducting layer being extended at 22*a* in the region of the outer face of the collar 24), and a rear part of which is able to come into contact with the conducting coating 16 formed on the casing 14 of the lamp 10. Here again a conducting seal can be used.

Moreover, the crown ring 25 carries a leaf spring 252 for retaining the lamp, similar to the leaf spring 232 described above.

Here again, the electrical continuity is ensured between the screening 16 of the casing 14 of the lamp and the screening 22 of the mirror.

Figure 12:
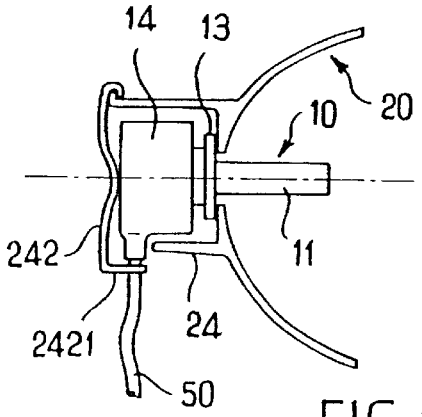
FIG. 12 is a side view, partially in section, illustrating a means for screening continuity between lamp and cable used with a lamp according to the invention.

FIG. 12 for its part illustrates an improvement to the retaining leaf spring 242, here mounted directly on a collar 24 produced in a single piece with the mirror 20 or else affixed onto it. According to this improvement, the leaf spring 242 carries an appendage 2421 intended to cover over, with electrical conduction, the bare outer braid of the power-supply cable 50. This especially makes it possible to achieve electrical continuity between the said braid and the screening 22 of the mirror 20, the electrical continuity of which with the leaf spring 242 is achieved by any appropriate means.

Figure 13:
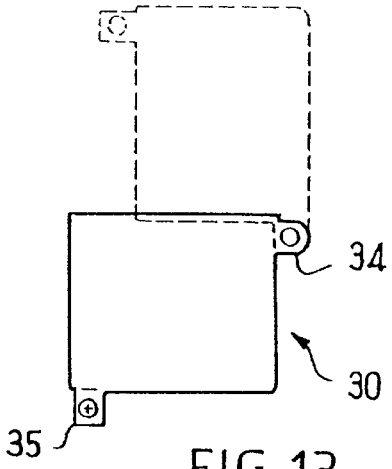
FIG. 13 is a diagrammatic back view of a rear cap of a mirror capable of being used in the second embodiment of the invention.

FIG. 13 illustrates a particular embodiment of the mounting of the screening cover 30 of FIG. 5 around the rear part of the lamp. The cover 30 possesses a first appendage 34 by which it is mounted so as to pivot on a spindle integral with the mirror, and a second appendage by which, with the cover being in place covering over the lamp, it is held in position with the aid of a screw or the like.

Figure 14:
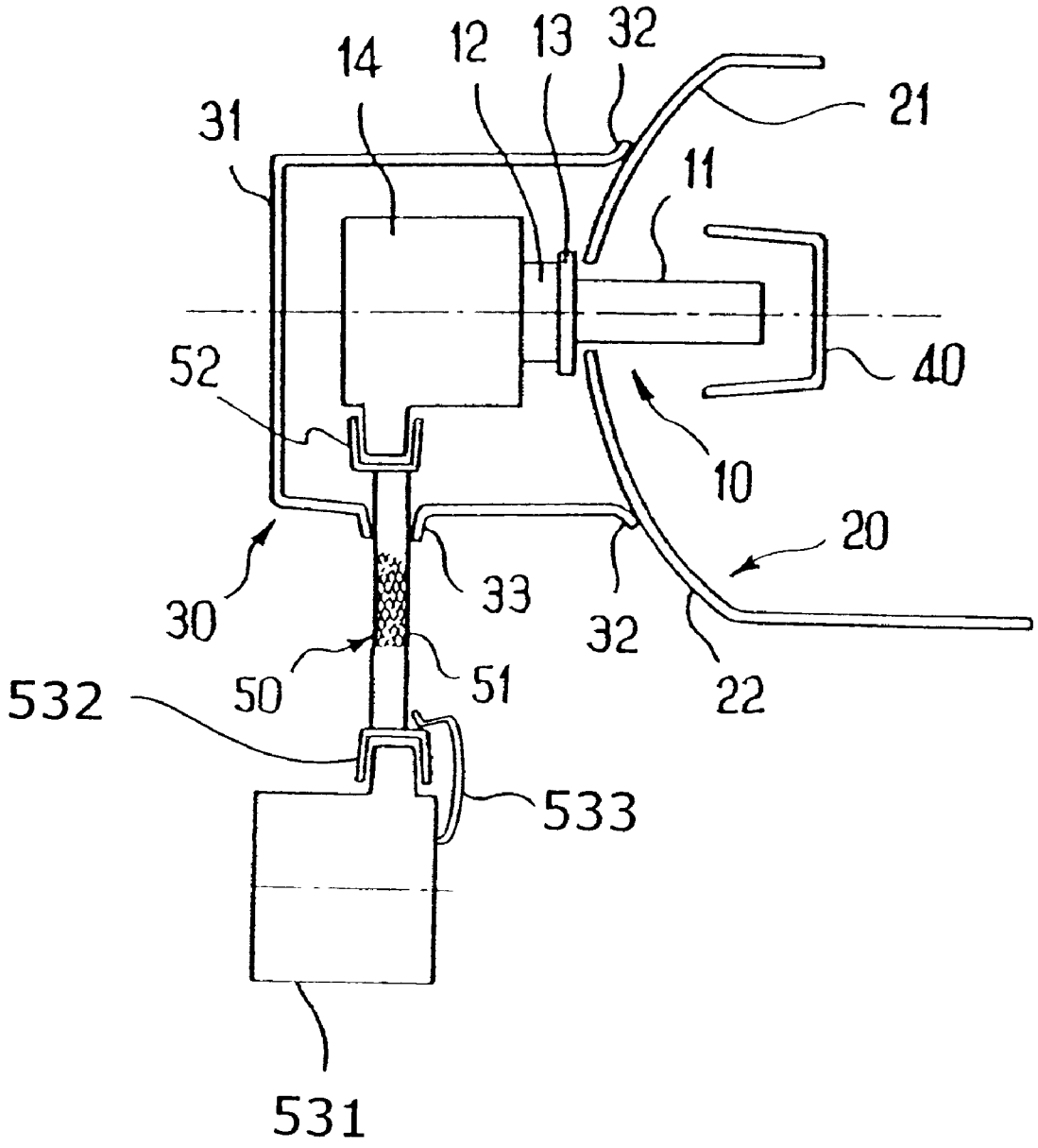
FIG. 14 is a side view, partially in section, of a lamp/mirror assembly, as shown in FIG. 5, further illustrating conductive links between a control box and a screened cable.

Finally, FIG. 14 is a side view, partially in section, of a lamp/mirror assembly, as shown in FIG. 5, and further illustrates features of the invention described above. FIG. 14 shows an earthed conducting casing or control box 531, which shelters a DC—DC converter and, more generally, additional control circuits of the headlight. The conducting casing 531 can be connected to the screening braid 51 near one end of the power supply cable 50 via connectors 532 and 533, which ensure electrical conductivity between the screening braid 51 and the conducting casing 531.

Clearly, the present invention is not in any way limited to the embodiments described and represented, but the person skilled in the art will be able to contribute numerous variants and modifications.

What we claim is:

1. A motor-vehicle headlight, comprising a gas-discharge lamp combined with a power-supply circuit and mounted in a mirror, and means of screening with respect to interfering electromagnetic emissions, the screening means comprising a conducting material, wherein the said power-supply circuit is accommodated in a housing associated with the lamp to the rear thereof, and the housing including the screening means which surrounds the power-supply circuit and is able to provide electrical continuity between a screening braid of a power-supply cable arriving at the said housing and screening arrangements which are associated with the mirror, wherein the headlight further comprises a second linking means for ensuring electrical continuity between the conducting material surrounding the housing and the screening braid, the second linking means including a conductive elastic means for retaining the lamp in axial position and bearing against the conducting, screening material, and wherein the elastic means, which is conducting and which, in the retaining position, is in contact with the screening braid of the cable.

2. The headlight as claimed in claim 1, wherein the housing comprises a casing which includes said conducting material.

3. The headlight as claimed in claim 2, wherein the said conducting material is mechanically fixed to the outside of the said casing.

4. The headlight as claimed in claim 2, wherein the said conducting material is deposited on an outer face of the said casing.

5. A motor-vehicle headlight, comprising a gas-discharge lamp combined with a power-supply circuit and mounted in a mirror, and means of screening with respect to interfering electromagnetic emissions, the screening means comprising a conducting material;

wherein the said power-supply circuit is accommodated in a housing associated with the lamp to the rear thereof, and the housing including the screening means which surrounds the power-supply circuit and is able to provide electrical continuity between a screening braid of a power-supply cable arriving at the said housing and screening arrangements which are associated with the mirror;

wherein the said conducting material belongs to a cover affixed to the rear of the mirror and surrounding a non-conducting casing defining the said housing.

6. The headlight as claimed in claim 1, which comprises first linking means for ensuring electrical continuity between the said conducting material surrounding the said housing and a second, screening, conducting material provided at the rear surface of the mirror.

7. The headlight as claimed in claim 6, wherein the said conducting material belongs to a casing defining the said housing, the said conducting material is mechanically fixed to the outside of the said casing, and the first linking means comprises a series of clips electrically linked to the said second conducting material and bearing against the said first conducting material.

8. The headlight as claimed in claim 6, wherein the said conducting material belongs to a casing defining the said housing, the said conducting material is deposited on an outer face of the said housing and the first linking means comprises a series of clips electrically linked to the said second conducting material and bearing against the said first conducting material.

9. The headlight as claimed in claim 7, wherein the said clips are mounted on a lamp holder affixed to the mirror.

10. The headlight as claimed in claim 8, wherein the said clips are mounted on a lamp holder affixed to the mirror.

11. A motor-vehicle headlight, comprising a gas-discharge lamp combined with a power-supply circuit and mounted in a mirror, and means of screening with respect to interfering electromagnetic emissions, the screening means comprising a conducting material;

wherein the said power-supply circuit is accommodated in a housing associated with the lamp to the rear thereof, and the housing including the screening means which surrounds the power-supply circuit and is able to provide electrical continuity between a screening braid of a power-supply cable arriving at the said housing and screening arrangements which are associated with the mirror;

wherein the headlight comprises first linking means for ensuring electrical continuity between the said conducting material surrounding the said housing and a second, screening, conducting material provided at the rear surface of the mirror;

wherein the said conducting material belongs to a cover affixed to the rear of the mirror and surrounding a non-conducting casing defining the said housing and wherein the first linking means comprise arrangements for supporting the said cover against the said second conducting material at the rear of the mirror.

12. The headlight as claimed in claim 6, wherein the first linking means comprise a deformable seal made of electrically conducting material, interposed between the first and second conducting materials.

13. The headlight as claimed in claim 12, wherein the deformable seal is mounted on the mirror.

14. The headlight as claimed in claim 12, wherein the deformable seal is mounted on a lamp holder affixed to the mirror.

15. The headlight as claimed in claim 1, which comprises second linking means for ensuring electrical continuity between the said conducting material surrounding the said housing and the said screening braid.

16. The headlight as claimed in claim 15, wherein the said conducting material belongs to a casing defining the said housing, wherein the said conducting material is mechanically fixed to the outside of the said casing, wherein the casing of the lamp possesses a first connector, the end of the power-supply cable possesses a second connector able to plug into the first connector, and wherein, when the first and second connectors are separated, the said second linking means are able to break the electrical continuity between the said conducting material surrounding the said housing and the said screening braid only after the contacts of the first and second connectors carrying the power-supply voltage for the lamp have been separated.

17. The headlight as claimed in claim 15, wherein the said conducting material belongs to a casing defining the said housing, wherein the said conducting material is deposited on an outer face of the said housing wherein the casing of the lamp possesses a first connector, wherein the end of the power-supply cable possesses a second connector able to plug into the first connector, and wherein, when the first and second connectors are separated, the said second linking means are able to break the electrical continuity between the said conducting material surrounding the said housing and the said screening braid only after the contacts of the first and second connectors carrying the power-supply voltage for the lamp have been separated.

18. The headlight as claimed in claim 16, wherein the second linking means comprise a series of clips carried by the said second connector, the said clips being in contact with the screening braid and with the conducting material surrounding the casing.

19. The headlight as claimed in claim 17, wherein the second linking means comprise a series of clips carried by the said second connector, the said clips being in contact with the screening braid and with the conducting material surrounding the casing.

20. The headlight as claimed in claim 16, wherein the said second linking means comprise a conducting seal in contact with the screening braid and with the conducting material surrounding the casing.

21. The headlight as claimed in claim 17, wherein the said second linking means comprise a conducting seal in contact with the screening braid and with the conducting material surrounding the casing.

22. The headlight as claimed in claim 15 wherein the said conducting material belongs to a casing defining the said housing, the said conducting material is mechanically fixed to the outside of the said casing.

23. The headlight as claimed in claim 15 wherein the said conducting material belongs to a casing defining the said housing, the said conducting material is deposited on an outer face of the said housing.

24. A motor-vehicle headlight, comprising a gas-discharge lamp combined with a power-supply circuit and mounted in a mirror, and means of screening with respect to interfering electromagnetic emissions, the screening means comprising a conducting material;

wherein the said power-supply circuit is accommodated in a housing associated with the lamp to the rear thereof, and the housing including the screening means which surrounds the power-supply circuit and is able to provide electrical continuity between a screening braid of a power-supply cable arriving at the said housing and screening arrangements which are associated with the mirror;

wherein the headlight comprises second linking means for ensuring electrical continuity between the said conducting material surrounding the said housing and the said screening braid;

wherein the said conducting material belongs to a cover affixed to the rear of the mirror and surrounding a non-conducting casing defining the said housing, and wherein the said second linking means comprise arrangements for support against the braid of the power supply cable, which are formed on the said cover around an orifice for the said cable to pass.

25. The headlight as claimed in claim 1, wherein the said housing forms an integral part of the lamp.

26. The headlight as claimed in claim 1, wherein the said housing forms part of a connector on which the lamp is mounted removably.

27. The headlight as claimed in claim 1, which further comprises control circuits accommodated in an electrically conducting control box situated at a distance from the lamp, and third linking means for ensuring electrical continuity between the said control box and the braid of the cable.

28. The headlight as claimed in claim 27, wherein the third linking means comprise a third connector provided on the control box and a fourth connector provided at the end of the power-supply cable (50) opposite to the lamp and able to be plugged into the third connector, and wherein, when the third and fourth connectors are separated, the said third linking means are able to break the electrical continuity between the said control box and the said screening braid (51) only after the contacts of the third and fourth connectors carrying the power-supply voltage for the lamp have been separated.

29. A gas-discharge lamp for a motor-vehicle headlight, the said lamp being combined with a power-supply circuit, which lamp incorporates the said power supply circuit, in a housing, and which further comprises screening means comprising a conducting material entirely surrounding the said housing and able to ensure electrical continuity between a screening braid of a power-supply cable arriving in the housing and screening arrangements provided on a mirror able to accommodate the said lamp, wherein the lamp engages with a second linking means for ensuring electrical continuity between the conducting material surrounding the housing and the screening braid, the second linking means including a conductive elastic means for retaining the lamp in axial position and bearing against the conducting, screening material, and wherein the elastic means, which is conducting and which, in the retaining position, is in contact with the screening braid of the cable.

30. The lamp as claimed in claim 29, wherein the said conducting material belongs to a casing defining the said housing.

31. The lamp as claimed in claim 30, wherein the said conducting material is mechanically affixed to the outside of the said casing).

32. The lamp as claimed in claim 30, wherein the said conducting material is deposited on an outer face of the said casing.

* * * * *